US007784456B2

(12) United States Patent
Chen

(10) Patent No.: US 7,784,456 B2
(45) Date of Patent: Aug. 31, 2010

(54) AIR-COMPRESSED BULLET GUN ASSEMBLY

(75) Inventor: Yi-Tsong Chen, Tainan (TW)

(73) Assignee: Chien-Chih Yeh, Tainan (TW)

( * ) Notice: Subject to any disclaimer, the term of this patent is extended or adjusted under 35 U.S.C. 154(b) by 307 days.

(21) Appl. No.: 12/169,645

(22) Filed: Jul. 9, 2008

(65) Prior Publication Data

US 2010/0006080 A1 Jan. 14, 2010

(51) Int. Cl.
*F41B 11/00* (2006.01)

(52) U.S. Cl. ..... 124/73; 124/71; 124/72; 124/74; 124/75; 124/76; 124/77

(58) Field of Classification Search ..... None
See application file for complete search history.

(56) References Cited

U.S. PATENT DOCUMENTS 7,401,607 B2 * 7/2008 Yeh ..... 124/74
7,520,275 B2 * 4/2009 Long ..... 124/73
2006/0169264 A1 * 8/2006 Lai ..... 124/71
2007/0113836 A1 * 5/2007 Dobbins ..... 124/73
2008/0011283 A1 * 1/2008 Lai ..... 124/73
2008/0245351 A1 * 10/2008 Kaakkola et al. ..... 124/74
2009/0013984 A1 * 1/2009 Spets ..... 124/73
2009/0178660 A1 * 7/2009 Huang ..... 124/73
2009/0178661 A1 * 7/2009 Wood ..... 124/73
2009/0199832 A1 * 8/2009 Long ..... 124/73

* cited by examiner

*Primary Examiner*—Troy Chambers
*Assistant Examiner*—Samir Abdosh
(74) *Attorney, Agent, or Firm*—Banger Shia

(57) ABSTRACT

An air-compressed bullet gun assembly with a length-reduced gun barrel is provided, including a barrel body, a bullet-firing device, a blocking element and a rear cover. The barrel body includes a hollow tube which further includes a 1st blocking flange and a 2nd blocking flange; the 2nd blocking flange divides the hollow tube into two connected parts: the 1st air chamber and the 2nd air chamber; the 1st air chamber includes a screw hole. The bullet firing device includes a 1st protruding flange, a 1st air-tight loop, a 2nd air-tight loop, a plurality of ventilators, and a guiding pole. The blocking element includes a locking hole, a 2nd protruding flange, and a 3rd air-tight loop. The rear cover includes a 5th air-tight loop.

4 Claims, 6 Drawing Sheets

AIR-COMPRESSED BULLET GUN ASSEMBLY

BACKGROUND OF THE INVENTION

1. Field of the Invention

This invention relates to an air-compressed bullet gun assembly, particularly to an air-compressed paint ball gun with a length-reduced gun barrel which achieves structural simplicity, reduced manufacture cost, and greater reliability.

2. Description of the Related Art

Referring to FIG. 4, a prior art classified as 'Paint ball gun structure' includes a barrel A, a front external body B, a rear external body C, a bullet firing body D and a rear guiding pole E, wherein the front external body B and the rear external body C are provided within the barrel A, while the bullet firing body is further provided within both the front external body B and the rear external body C. On one end of the rear external body C is provided with the rear guiding pole E. High pressure air fills into the rear external body C to make the bullet firing body D shift towards the front external body B in such a way that the bullet firing body D is separated from the rear guiding pole E for high-pressured air (stored originally within the rear external body C) to travel to the bullet firing body D, which in turn fire paint balls F.

Disadvantages associated with the above-mentioned prior art include:

(1) Both assembling and disassembling multiple parts (in manufacturing or repair) consumes time;

(2) Requires more efforts in maintenance of multiple parts;

(3) Requires high precision in compatible degrees of concentricity between the rear guiding pole E and the bullet firing body D for the former (i.e. rear guiding pole E) to slide into the latter (i.e. the bullet firing body D); and (4) When in operation, the rear guiding pole E is likely to be displaced due to a long-term pushing force from the bullet firing body D.

FIG. 5 disclosed another related prior art, which is an improvement on the embodiment shown in FIG. 4. The embodiment shown in FIG. 5 includes a hollow barrel G which further includes within a air-tight sleeve H into which a bullet firing body I is inserted; a cork sleeve J then slides into the hollow barrel H and contacts one end of the cork sleeve H. A rear cover K is then screwed at the rear end of the hollow barrel G while in the mean time, the other end of the rear cover K screws in with the cork sleeve J. Such an embodiment solves the issue for high precision in concentric degrees of multiple parts for assembling, which nevertheless results in an undesirably long barrel body and a plurality of necessary parts.

FIG. 6 disclosed another related prior art, which is an improvement on the embodiment shown in FIG. 5. The bullet firing body L is inserted into $1^{st}$ gun barrel M with the blocking element N to lean directly against the $1^{st}$ gun barrel M and one end of the bullet firing body L; the $2^{nd}$ gun barrel O is then screwed with the $1^{st}$ gun barrel M and make the blocking element N being fixed in position for the bullet firing body L to go through; an air-through seat body P is located at the rear end of the $2^{nd}$ gun barrel O; the air-through seat body P is partially covered with an air seat body Q for high-pressured air to flow in to the $2^{nd}$ gun barrel O; the air-through seat body P is further locked by a snapping element R to avoid the $2^{nd}$ gun barrel O from falling off; an air-tight element S is provided within the air-through seat body P to avoid leaking of high-pressured air. Such an improved embodiment may not require a long barrel body, which nevertheless has a dual parts of barrel and includes quite a lot of parts, undesirably increasing manufacturing cost, potential defectiveness and air leak.

SUMMARY OF THE INVENTION

It is the goal of this invention to provide some feasible solutions for the defects encountered in the afore-mentioned prior arts. It is therefore an object of this invention to provide an air-compressed bullet gun assembly, which do not have a lengthy barrel body and have less parts for assembling.

Compared with the prior arts, improvements in the present invention include:

a barrel body, which is hollow-shaped, including a $1^{st}$ blocking flange and a $2^{nd}$ blocking flange, each separated from the other. The $2^{nd}$ blocking flange further divides the hollow tube into two connected parts: the $1^{st}$ air chamber and the $2^{nd}$ air chamber; the $2^{nd}$ air chamber is positioned in between the $1^{st}$ blocking flange and the $2^{nd}$ blocking flange. The $1^{st}$ air chamber includes a screw hole.

a bullet firing device, a cylinder in shape, around which are disposed a $1^{st}$ protruding flange, a $1^{st}$ air-tight loop and a $2^{nd}$ air-tight loop; one end of the bullet firing device includes a plurality of ventilators. The bullet-firing device is positioned inside the hollow tube, with the $1^{st}$ protruding flange corresponds to the $1^{st}$ blocking flange 12 (of the barrel body). A guiding pole is provided on the utmost end, which can slide into the $1^{st}$ air chamber.

a blocking element, including in its center a locking hole. A $2^{nd}$ protruding flange is provided on one end of the external circumference of the blocking element, while a $3^{rd}$ air-tight loop is disposed on the other end of the external circumference. The $2^{nd}$ protruding flange always contacts tightly the $2^{nd}$ blocking flange due to the air pressure inside the $1^{st}$ air chamber (of the hollow tube). The locking hole corresponds to the guiding pole.

A rear cover, including a $5^{th}$ air-tight loop, is screwed in the screw hole (of the $1^{st}$ air chamber) to enclose within air pressure in the $1^{st}$ air chamber.

Preferably, a bumper loop is provided at the rear end of the $1^{st}$ air-tight loop.

Preferably, the blocking element is a loop.

Preferably, the rear cover is embodied as a bolt.

Advantages of the current invention include:

1. The rear cover does not need to be designed to correspond to the bullet-firing device to lock in with the bullet firing, which greatly reduces the length of the barrel body, and makes the product handy.

2. Since the rear cover is separated from the bullet-firing device and there is no guiding pole disposed on the rear cover, there is no need to include precision of concentric degrees between parts in manufacturing products, which greatly reduces chances of defective products.

3. The simplistic structure of the current invention makes maintenance or repair easy and convenient.

4. Less parts are required in the current invention, which saves cost in manufacturing parts as well as time in assembling parts.

BRIEF DESCRIPTION OF THE DRAWINGS

These and other features and advantages of this invention will become apparent in the following detailed description of the preferred embodiment of this invention, with reference to the accompanying drawings, in which.

DETAILED DESCRIPTION OF THE PREFERRED EMBODIMENTS

Figure 1:
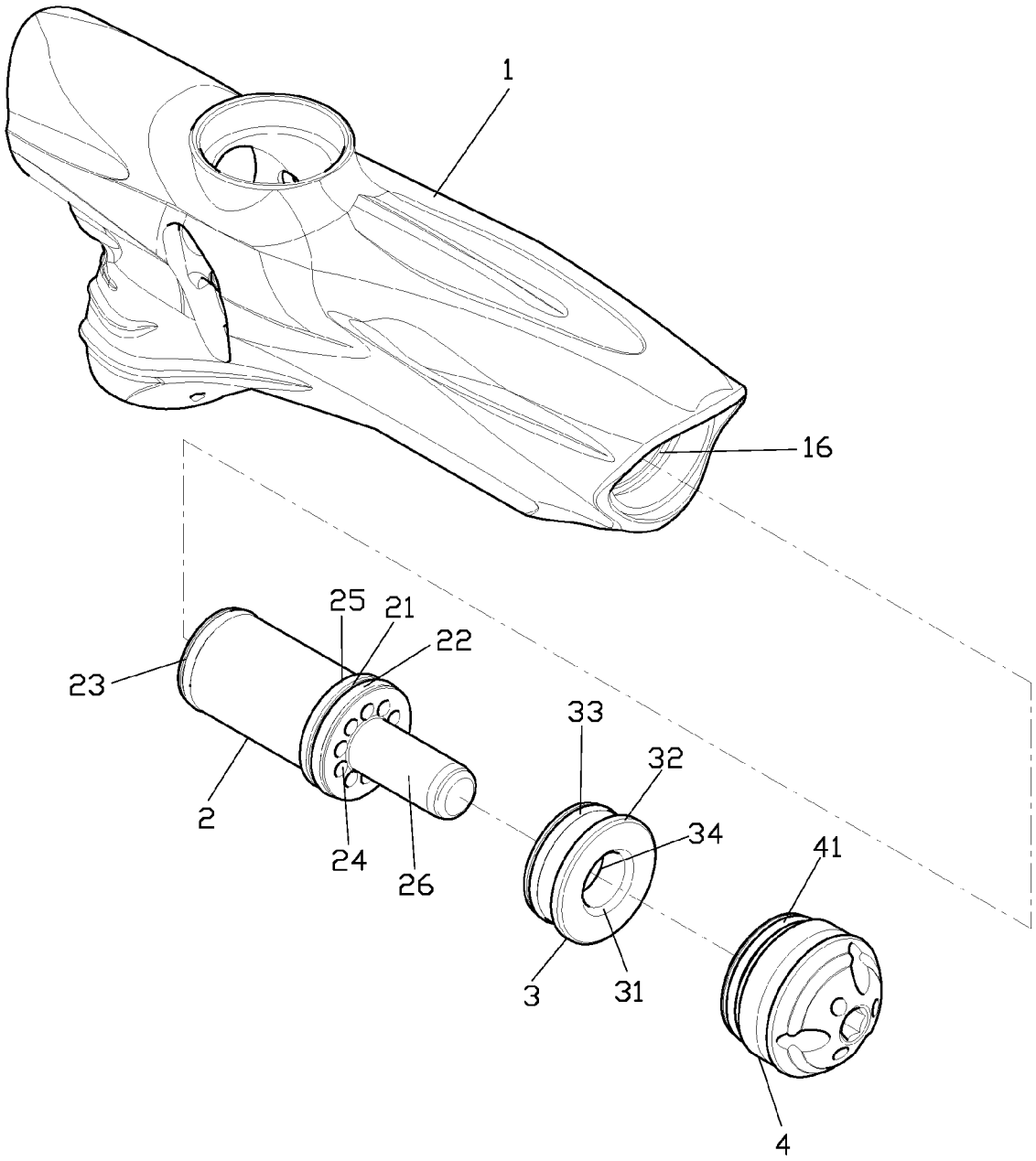
FIG. 1 is an exploded perspective view of a preferred embodiment in accordance with the invention.

Parts or elements referred to in the invention with a symmetrical structure and identical functions are designated by the same reference numerals throughout the entire disclosure.

Figure 2:
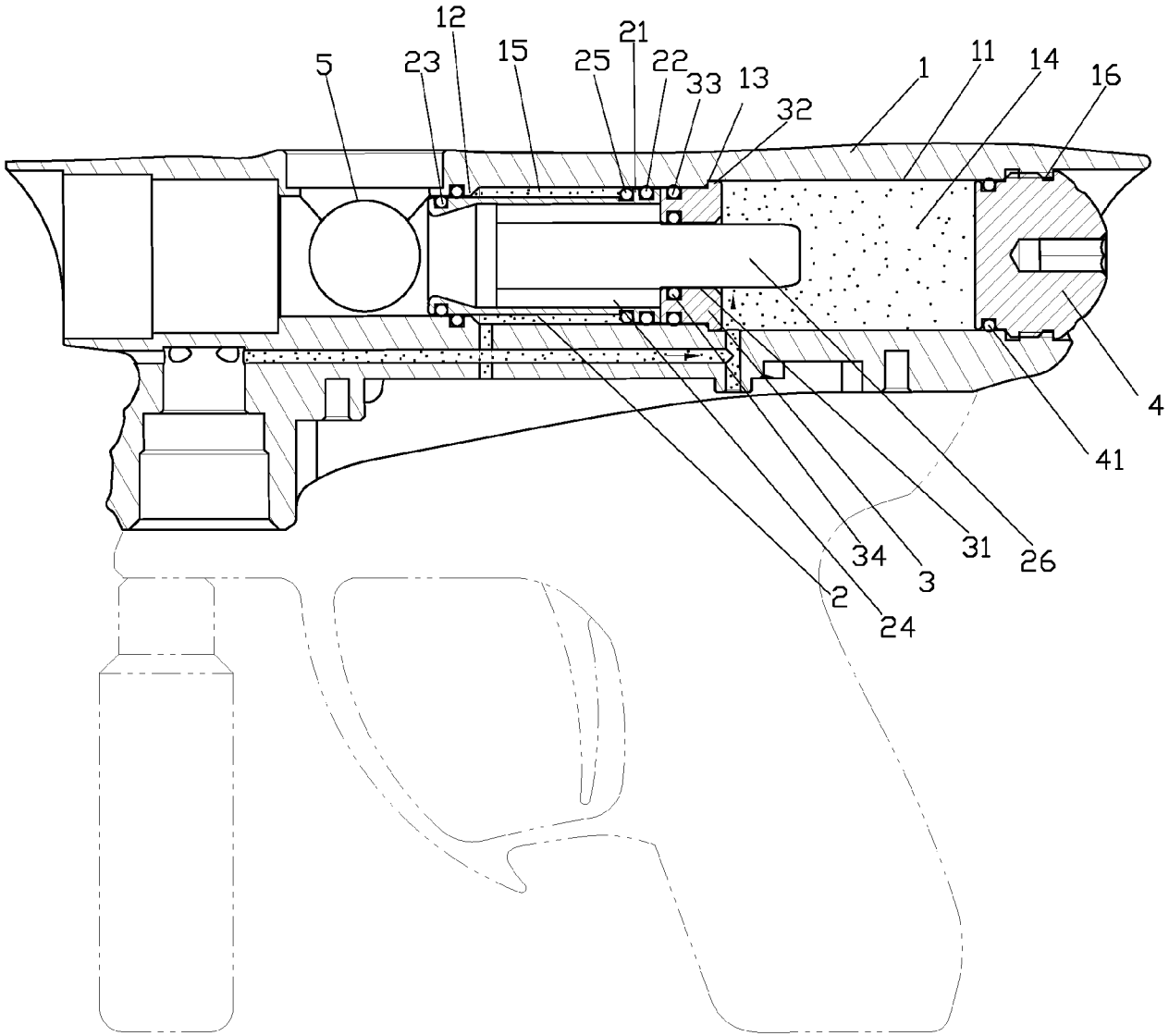
FIG. 2 a cross-sectional view of a preferred embodiment in accordance with the invention.

Referring to FIGS. 1-2, the first preferred embodiment of this invention includes the following parts: a barrel body 1, a bullet-firing device 2, a blocking element 3 and a rear cover 4. Details of the above four parts are described below.

The barrel body 1 includes a hollow tube 11 which further includes a 1st blocking flange 12 and a 2nd blocking flange 13, whereas the 1st blocking flange 12 and the 2nd blocking flange 13 are separated (or disconnected) from each other. The 2nd blocking flange 13 further divides the hollow tube 11 into two connected parts: the 1st air chamber 14 and the 2nd air chamber 15; the 2nd air chamber 15 is positioned in between the 1st blocking flange 12 and the 2nd blocking flange 13. A screw hole 16 is provided on top of the 1st air chamber 14.

The bullet firing device 2 has a cylindrical shape, around which are provided a 1st protruding flange 21, a 1st air-tight loop 22 and a 2nd air-tight loop 23; one end of the bullet firing device 2 includes a plurality of ventilators 24. The bullet-firing device 2 is positioned inside the hollow tube 11, with the 1st protruding flange 21 corresponds to the 1st blocking flange 12 (of the barrel body 1). One end of the 1st air-tight loop 22 is provided with a bumper loop 25 as a buffer against force coming from the bullet firing device 2. The 1st air-tight loop 22 and the bumper loop 25 are positioned within the 2nd air chamber 15. A guiding pole 16 is provided on the utmost end, which slides into the 1st air chamber 14.

The blocking element 3 is a loop, in the center of which is disposed a locking hole 31. A 2nd protruding flange 32 is provided on one end of the external circumference of the blocking element 3, while a 3rd air-tight loop 33 is disposed on the other end of the external circumference. The 2nd protruding flange 32 always contacts tightly the 2nd blocking flange 13 due to the air pressure inside the 1st air chamber 14 (of the hollow tube 11). An air-tight 4th loop 34 is positioned inside the locking hole 31, corresponding to the guiding pole 26, for the guiding pole 26 (of the bullet firing device 2) to run through and to lock in with.

The rear cover 4 has a bolt shape, including a 5th air-tight loop 41, is screwed in the screw hole 16 (of the 1st air chamber 14) to enclose within air pressure in the 1st air chamber 14.

Figure 3:
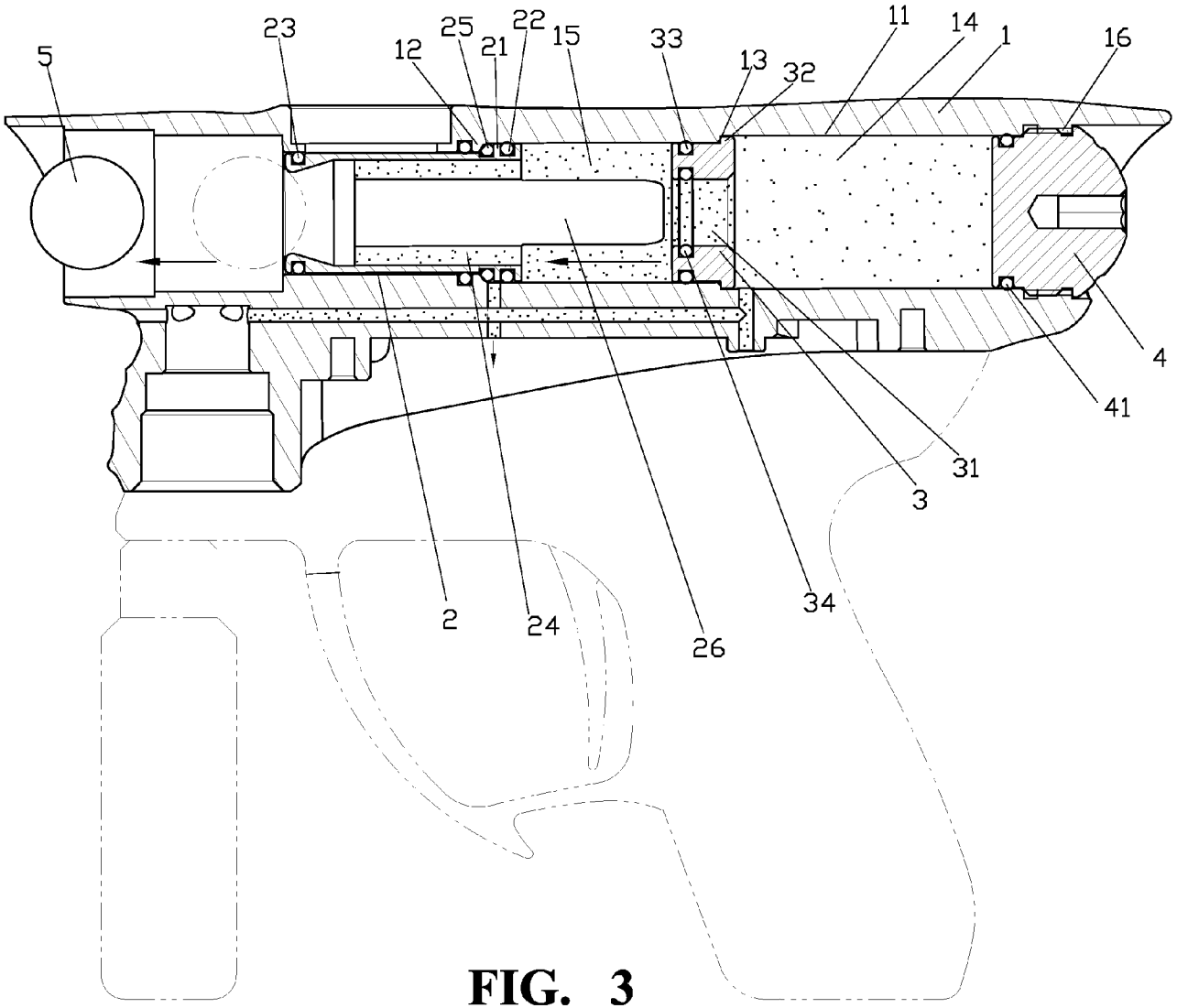
FIG. 3 illustrates a preferred embodiment in accordance with the invention when firing a bullet.
Figure 4:
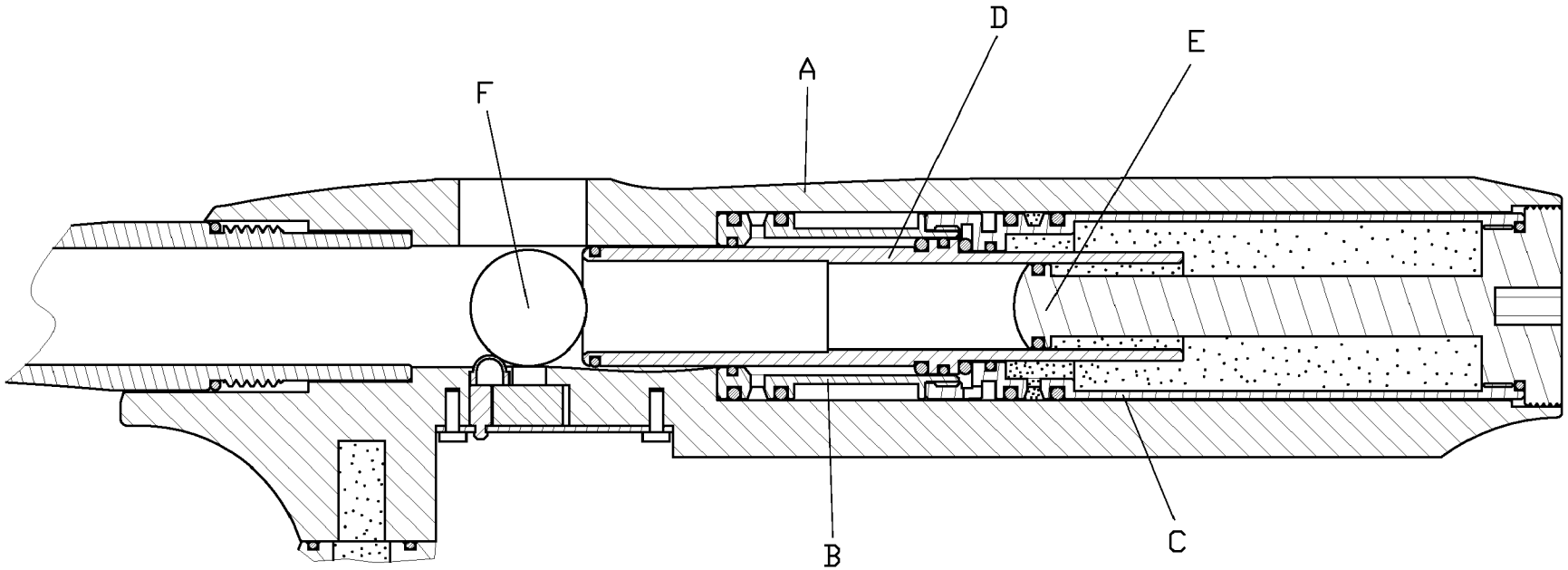
FIG. 4 Prior Art
FIG. 4 illustrates a 1st prior art of a paint ball gun.
Figure 5:
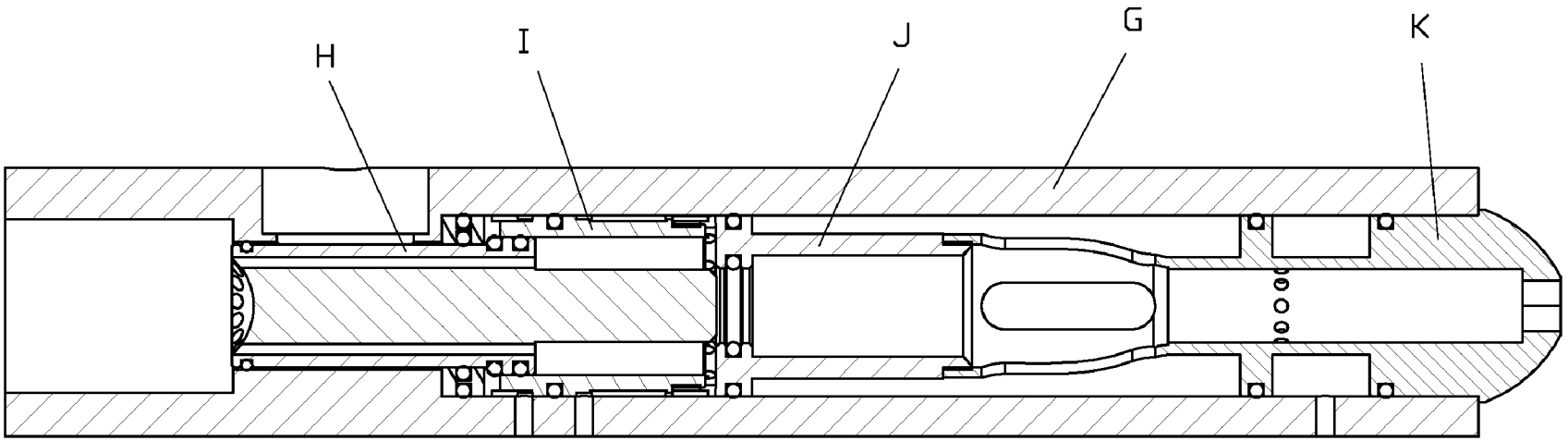
FIG. 5 Prior Art
FIG. 5 illustrates a 2nd prior art of a paint ball gun.
Figure 6:
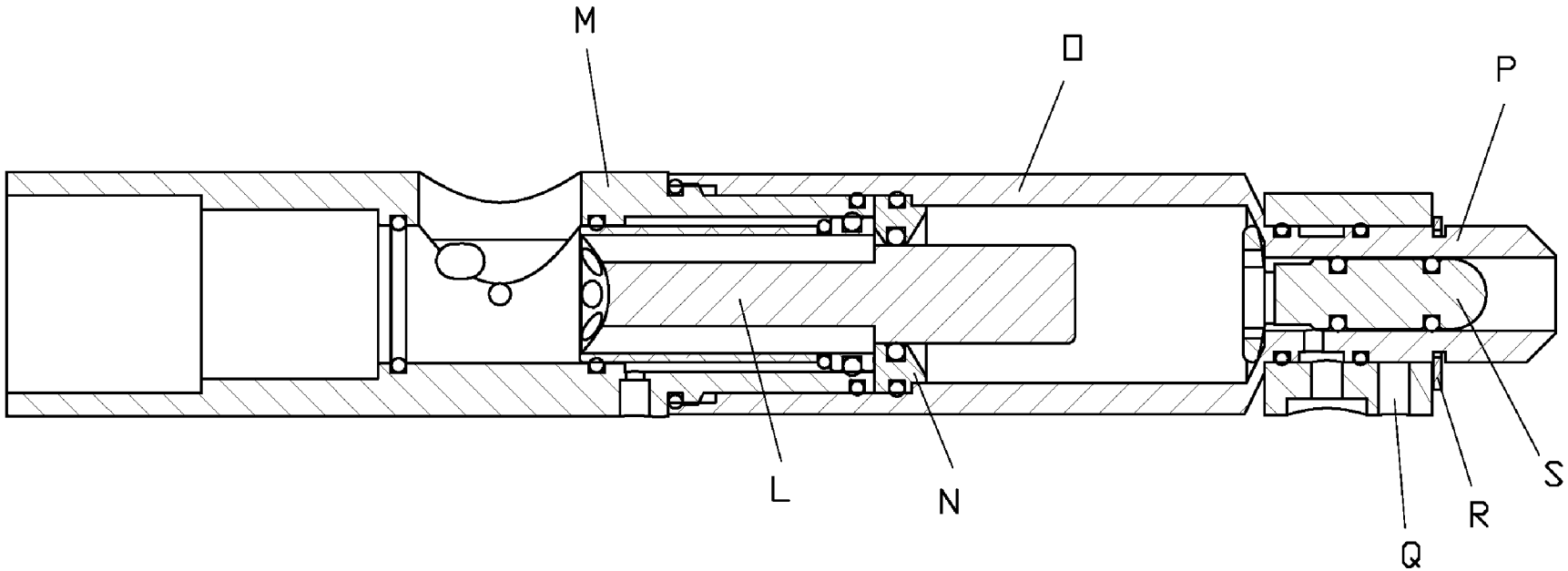
FIG. 6 Prior Art
FIG. 6 illustrates a 3rd prior art of a paint ball gun.

When firing a bullet, as illustrated in FIGS. 2 and 3, high-pressured air in the barrel body 1 flows into the 1st air chamber 14 (of the hollow tube 11). Meanwhile, the guiding pole 26 (of the bullet firing device 2) runs through the locking hole 31 (which connects tightly to the blocking element 3). Due to high pressured air, the blocking element 3 forces the 2nd protruding flange 32 to contact tightly with the 2nd blocking flange 13, and the 3rd air-tight loop 33 contacts with the inside wall of the 2nd air chamber 15 (of the hollow tube 11), forming an air-tight chamber to store high-pressured air. While high-pressured air keeps coming into the 1st air chamber 14, pressure of air within the 1st air chamber 14 also keeps increasing to balance the air pressure between the 1st air chamber 14 and the 2nd air chamber 15. Accordingly, high-pressured air in the 1st air chamber 14 pushes towards the guiding pole 26 (of the bullet firing device 2), which in turn pushes the bullet 5 (e.g. a paint ball) step by step until the guiding pole 26 finally falls off from the locking hole 31 (of the blocking element 3) and leaves a space so that high-pressured air in the 1st air chamber 14 flows through the ventilators 24 (of the bullet firing device 2) and fires the bullet 5 out.

In summary, in the current invention, the rear cover 4 is screwed directly in the screw hole 16 (of the 1st air chamber 14); hence, the rear cover 4 does not need to lock in with the bullet firing device 2. The 2nd protruding flange 32 always contacts tightly with the 2nd blocking flange 13 (which is located in between the 1st air chamber 14 and the 2nd air chamber 15). The above-mentioned unique design significantly reduces the length of the barrel body and the number of assembling parts, which is cost-effective in both manufacturing and maintenance.

While the present invention has been described in connection with the most practical and preferred embodiment, it is understood that this invention is not limited to the disclosed embodiment but is intended to cover various arrangement included within the spirit and scope of the broadest interpretation so as to encompass all such modifications and equivalent arrangements.

I claim:

1. An air-compressed bullet gun assembly, including a barrel body, which includes a hollow tube which further includes a 1st blocking flange and a 2nd blocking flange, wherein said 1st blocking flange and said 2nd blocking flange are disconnected from each other, said 2nd blocking flange divides said hollow tube into two connected parts: the 1st air chamber and the 2nd air chamber, said 2nd air chamber is disposed in between said 1st blocking flange and said 2nd blocking flange, and said 1st air chamber is provided with a screw hole;

a bullet-firing device with two ends, in a cylindrical shape, positioned inside said hollow tube, including a 1st protruding flange which corresponds to said 1st blocking flange of said barrel body; around said bullet-firing device are provided a 1st protruding flange, a 1st air-tight loop and a 2nd air-tight loop, wherein one end of said bullet-firing device includes a plurality of ventilators and a guiding pole;

a blocking element with a center and two ends, including a locking hole in said center, a 2nd protruding flange on one of said two ends, and a 3rd air-tight loop on the other of said two ends, wherein said 2nd protruding flange contacts tightly against said 2nd blocking flange, said locking hole corresponds to said guiding pole for locking purpose and said locking hole further includes a 4th air-tight loop; and a rear cover, including a 5th air-tight loop and is screwed within said screw hole.

2. The air-compressed bullet gun assembly as claimed in claim 1, wherein said 1st air-tight loop includes a bumper loop.

3. The air-compressed bullet gun assembly as claimed in claim 1, wherein said blocking element is a loop.

4. The air-compressed bullet gun assembly as claimed in claim 1, wherein said rear cover is a bolt.

* * * * *